United States Patent [19]

Dimmick et al.

[11] 3,942,064

[45] Mar. 2, 1976

[54] REINFORCING RING STRUCTURE FOR A SHADOW MASK

[75] Inventors: George D. Dimmick, Bath; Kevin J. Rhodes, Montour Falls; Richard W. Uzumecki, Horseheads, all of N.Y.

[73] Assignee: Westinghouse Electric Corporation, Pittsburgh, Pa.

[22] Filed: Nov. 14, 1974

[21] Appl. No.: 523,945

[52] U.S. Cl. ..... 313/407

[51] Int. Cl.[2] ..... H01J 29/07; H01J 31/20

[58] Field of Search ..... 313/402, 407, 406, 404, 313/405

[56] References Cited

UNITED STATES PATENTS

| | | | |
|---|---|---|---|
| 3,516,147 | 6/1970 | Seedorff et al. | 313/407 X |
| 3,639,799 | 2/1972 | Kirchner | 313/402 |

*Primary Examiner*—Robert Segal

*Attorney, Agent, or Firm*—W. G. Sutcliff

[57] ABSTRACT

A multipiece reinforcing ring for a color television picture tube shadow mask. A plurality of elongated pieces are rigidly connected at their end portions to form a rectangular back ring.

2 Claims, 4 Drawing Figures

REINFORCING RING STRUCTURE FOR A SHADOW MASK

BACKGROUND OF THE INVENTION

1. Field of the Invention

The invention is directed towards a shadow mask back ring structure for use in color television picture tubes.

2. Description of the Prior Art

A shadow mask is an apertured, curved conductive member, which operates as the electron beam limiting electrode in a color television picture tube. An example of the typical shadow mask structure is seen in U.S. Pat. No. 3,639,799. The shadow mask typically has a curved aperture face portion surrounded by a solid skirt portion which is bent in a direction normal to the face portion of the shadow mask. This type of mask is typically formed of relatively thin metal to minimize the weight of the structure, and also to minimize thermal effects. It has been the practice to utilize a relatively thicker unitary metal reinforcing ring which is rigidly affixed to the back end of the mask shirt portion to strengthen and stabilize the shadow mask. It has been found necessary to use a unitary reinforcing ring to achieve the desired strength, and to avoid distortion due to nonsymmetrical thermal heating.

In preparing such a unitary reinforcing ring, it has been the practice to stamp such rings from large metallic sheets. This structure and fabricating process results in significant scrap losses, and thus is an expensive, high waste production process.

SUMMARY OF THE INVENTION

It has been found possible to fabricate a generally rectangular reinforced shadow mask which has a generally rectangular planar back ring formed of a plurality of elongated pieces. The pieces are rigidly connected at their end portions to form the rectangular back ring. The number of pieces and the locus of connection between the pieces is symmetrical relative to the four corners of the rectangular back ring formed thereby.

The rectangular back ring is preferably formed of four pieces which are overlapped at the corners of the rectangle which is formed thereby. The overlapped portions are spot welded together.

DESCRIPTION OF THE PREFERRED EMBODIMENTS

Figure 1:
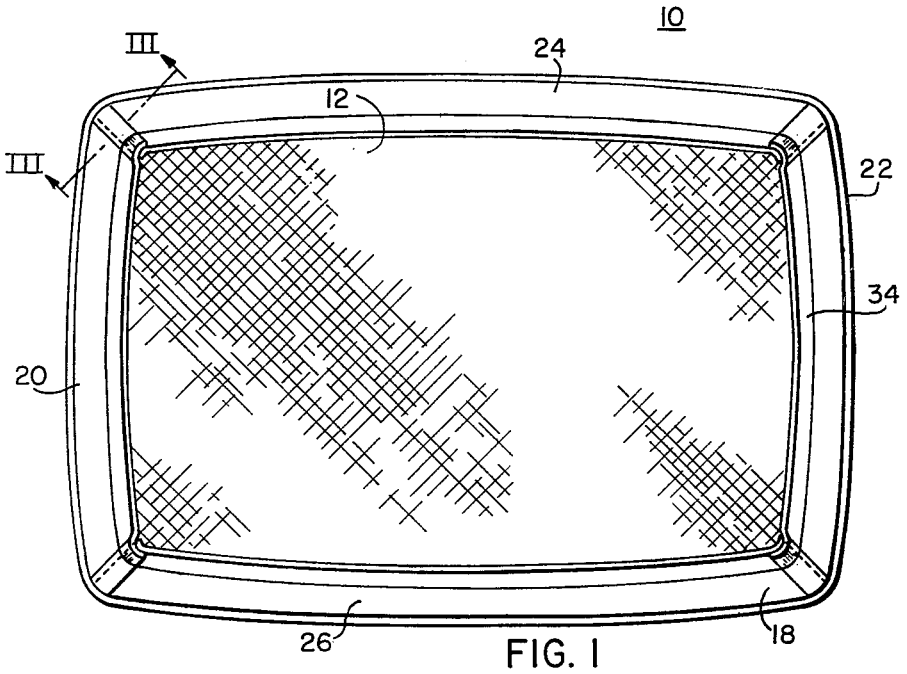
FIG. 1 is a rear elevational view of the reinforced shadow mask of the present invention.
Figure 2:
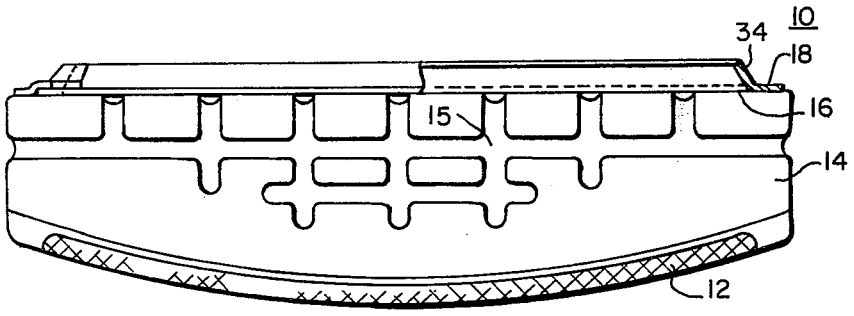
FIG. 2 is a top view of an embodiment of the reinforced shadow mask of the present invention.

In the exemplary embodiments seen in the drawings, the shadow mask 10 is seen in FIG. 1, in the direction of electron beam movement, or from the back side of the mask. The shadow mask 10 comprises an apertured face portion 12, surrounded by a solid skirt portion 14 as seen in FIG. 2 which is continued and deformed at an angle normal to the face portion 12. The terminal end of the solid skirt is formed into a planar attachment flange 16 which is in turn at an angle normal to the skirt 14. A multipiece reinforcing back ring 18 is attached to the attachment flange 16, preferably by spot welding. A plurality of reinforcing ribs 15 may be formed in the skirt 14.

The reinforcing back ring 18 is formed of a plurality of individual pieces cut to length. The back ring 18 is rectangular as is the standard showdow mask, and preferably is formed of four pieces, two short side pieces 20, 22, and two long side pieces 24, 26. These pieces are formed into the desired rectangular arrangement with an area of overlap at each of the corner portions of the rectangle. It is important that the overlap portions of the side pieces 20, 22, 24, 26, which are connected together by symmetrical relative to the four corners of the rectangular back ring. This is to prevent thermal distortion of the mask and the back ring during operation of the color picture tube in which the mask is disposed. The mask is thermally heated during tube operation due to electron bombardment, and any mask distortion will produce beam misregister with the phosphor display areas.

The elongated pieces 20, 22, 24, 26 from which the back ring 18 is formed are cut to length from strip metal of the proper width, thus essentially eliminating scrap costs.

The shadow mask 10 is formed of a unitary sheet of metal about six thousandths of an inch thick. The elongated pieces which form the back ring 18 are preferably about forty thousandths of an inch thick. The thickness of these metal members may be varied, but it is preferred that the back ring be formed of heavier gauge material which is about seven times as thick as the shadow mask itself.

Figure 3:
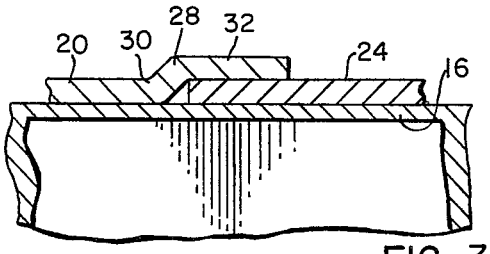
FIG. 3 is a sectional view taken through a corner of the reinforcing ring along line III—III of FIG. 1, to show the overlapped structure.

The extending ends of the short sides, 20, 22 and long sides 24, 26 overlap at the corners of the rectangle formed thereby, with a small portion of the short and long sides extending beyond the diagonal of the rectangle. As seen in FIG. 3, the short side end 28 is deformed to permit the overlap connection of the pieces, and to maintain the planar configuration on the back ring side which is mated with the planar attachment flange 16 of the shadow mask.

The short side end 28 comprises, a bend portion 30 which is angled away from the planar mating side of the back ring, and a planar end portion 32 which is in a plane parallel to the main back ring plane. The bend portion 30 is dimensioned to permit the long side 24 to be disposed in coplanar relationship with the short side 20, and more particularly with the back ring side facing the attachment flange 16 being planar.

The back ring pieces are spot welded at the overlap, and then the inner edge 34 of back ring 18 is flared upward as seen in FIGS. 1 and 2 as a shielding flange, as is conventional.

Figure 4:
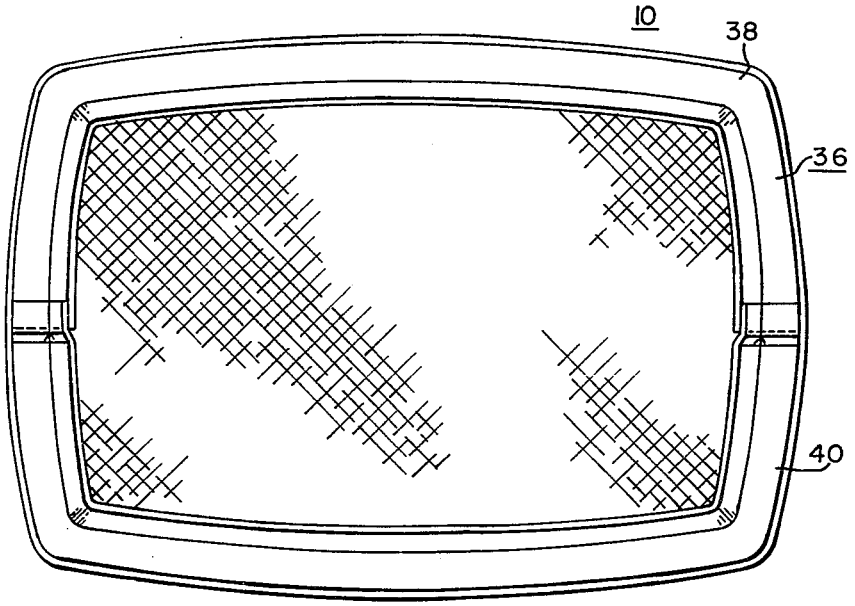
FIG. 4 is a rear elevational view of an alternative embodiment for a reinforcing ring for the present invention.

In the embodiment seen in FIG. 4, the back ring 36 is formed of two identical U-shaped pieces 38, 40, which are joined together to form the rectangular back ring 36. The extending ends of the pieces 38, 40 overlap here at the mid-point of the short side of the rectangular back ring in the same manner as shown in FIG. 3 to present a planar side of back ring 36 for welding to the attachment flange of the shadow mask 10.

The overlap connection of pieces 38, 40 is at points which are symmetrical with respect to the four corners of the rectangular back ring to again minimize any thermal distortion.

What we claim is:

1. A generally rectangular reinforced shadow mask for a color television picture tube comprising a thin metal sheet having a front section with a curved apertured transmission area, an imperforate margin area around the apertured transmission area, a further imperforate skirt portion bent back orthogonal to the margin area, the terminal portion of the skirt portion bent inwardly forming an attachment flange, and a generally planar rectangular back ring attached in surface supporting relationship to the flange, the improvement wherein the generally planar rectangular back ring is formed of a plurality of elongated pieces which are rigidly connected at their end portions to form the rectangular back ring, the overlap connection between pieces is made by providing an elbow like end portion on one end of each piece extending first from the plane of the piece and then generally parallel to the plane of the piece, with the dimension between the parallel planes being approximately equal to the piece thickness, the other end of each piece is planar and is disposed against the generally parallel portion of the elbow like end portion, with the number of pieces and the locus of connections symmetrical relative to the four corners of the rectangular back ring formed thereby, and wherein the overlapped pieces are spot welded together at the overlap where the planar end of one piece is disposed against the generally parallel portion of the elbow like end portion.

2. The shadow mask specified in claim 1, wherein the generally planar rectangular back ring is formed of four overlapped pieces, which are overlapped at the corners of the rectangle.

* * * * *